United States Patent [19]

Purvey

[11] Patent Number: 4,787,975

[45] Date of Patent: Nov. 29, 1988

[54] DISPOSABLE CARTRIDGES FOR CENTRIFUGAL SEPARATORS

[75] Inventor: Ronald J. Purvey, Devon, England

[73] Assignee: AE PLC, Rugby, England

[21] Appl. No.: 833,592

[22] Filed: Feb. 27, 1986

[30] Foreign Application Priority Data

Feb. 27, 1985 [GB] United Kingdom ..... 8504880

[51] Int. Cl.[4] ..... B04B 9/06

[52] U.S. Cl. ..... 210/360.1; 210/380.1; 494/49

[58] Field of Search ..... 210/168, 232, 354, 360.1, 210/380.1, ; 494/512.1, 24, 36, 49, 901

[56] References Cited

U.S. PATENT DOCUMENTS

| | | | |
|---|---|---|---|
| 2,865,562 | 12/1958 | Burke | 494/44 |
| 3,432,091 | 3/1969 | Beazley | 494/49 |
| 3,762,633 | 10/1973 | Ishii | 494/49 |
| 3,784,092 | 1/1974 | Gibson | 494/44 |
| 4,106,689 | 8/1978 | Kozulla | 494/49 |
| 4,165,032 | 8/1979 | Klingenberg | 494/49 |
| 4,288,030 | 9/1981 | Beazley et al. | 494/49 |
| 4,346,009 | 8/1982 | Alexander et al. | 494/49 |
| 4,400,167 | 8/1983 | Beazley et al. | 494/49 |
| 4,498,898 | 2/1985 | Haggett | 494/49 |
| 4,557,831 | 12/1985 | Lindsay et al. | 494/49 |
| 4,591,433 | 5/1986 | Budzich | 494/49 |

FOREIGN PATENT DOCUMENTS

| | | | |
|---|---|---|---|
| 710510 | 6/1954 | United Kingdom . | |
| 757538 | 9/1956 | United Kingdom | 494/49 |
| 1035542 | 7/1966 | United Kingdom . | |
| 1595816 | 8/1981 | United Kingdom . | |

*Primary Examiner*—Richard V. Fisher
*Assistant Examiner*—Wanda L. Millard
*Attorney, Agent, or Firm*—William R. Hinds

[57] ABSTRACT

Disposable cartridges are described which are formed from thin sheet metal pressings and wherein the base member has integrally-formed nozzles to produce less turbulent flow in the oil jets issuing from the nozzles than in known cartridges. Less turbulent oil flow allows greater oil flow rate for a given nozzle diameter than in known constructions where oil flow is more turbulent. The decreased turbulence promotes greater rotational velocity at a given oil pressure and enhances the efficiency of separation of contaminants from the oil. Disposable centrifugal separator cartridges are described comprising a cover member, an inner flow-directing and debris-retaining member, a base member, two bearings, one each associated with the cover member and the base member and wherein the base member is a sheet metal pressing having at least two nozzles formed integrally therein the through which oil leaves the cartridge in a direction so as to produce a reaction force to spin the cartridge, the nozzles being provided in recesses in the base member, the recesses being in the form of smoothly-contoured circumferential troughs of deepening section starting with minimum depth at the beginning of the trough remote from the nozzle and finishing with maximum depth near to the plane in which the nozzle lies.

13 Claims, 6 Drawing Sheets

DISPOSABLE CARTRIDGES FOR CENTRIFUGAL SEPARATORS

This invention relates to disposable cartridges for centrifugal separators, particularly centrifugal separators for use as fuel or lubricating oil cleaners for engines and transmission units such as internal combustion engines and gearboxes.

Centrifugal separator cartridges of the oil cleaner type are normally rotatably mounted on a vertical or near vertical shaft through which oil is introduced into the rotor and driven by the reaction force arising. when oil under pressure leaves through tangentially directed nozzles or jets usually situated at the bottom of the cartridge. We have found that the abililty of the nozzles to rotate the cartridge at high speed is impaired, and thus the cleaning ability of the separator is also impaired, if the oil flow through the nozzles becomes turbulent and this effectively limits the use of higher pressures within the cartridge to achieve higher speeds and therefore more efficient separation. Heretofore it has been usual to provide the nozzle opening in a side of a hollow rounded projection which extends downwards from the base of the cartridge and which is open to the interior of the cartridge at its upper end and closed at its lower end. The projection usually takes the form of a separate piece which is, for example, flanged at its upper end so that the projecting piece can be passed through a hole in the base of the cartidge until the flange rests on the periphery of the hole and can be secured in position, e.g. by soldering, brazing or welding. Because of the configuration and construction of such known cartridges the oil flow through and in the cartridge nozzle-piece is generally very turbulent thus limiting the rotational speed of the cartridge which may be achieved at any given oil pressure. The effect of turbulence is to limit the maximum rotational speed which the cartridge might otherwise have achieved.

It is an object of the present invention to provide a base for a disposable cartridge wherein the nozzles are formed integrally by pressing and which promote less turbulent oil flow maintained at higher oil-pressures than heretofore. It is also an object of the present invention to provide a cartridge which for a given oil pressure will rotate at higher revolutions per minute than known cartridges and will thus provide more efficient cleaning of the oil or fuel by removing smaller contaminant particle sizes for any given oil pressure.

A cartridge for a centrifugal oil separator must be able to withstand transient pressures of up to 20 bar during cold start-up conditions. The cartridge must, therefore, be able to withstand such pressures without permanent distortion.

Known cartridges are manufactured from a mixture of expensive machined castings and sheet metal pressings allowing the cartridge to be very rigid by using relatively thick metal sections. This is economic for a user where the cartridge may be disassembled, cleaned and re-used but for a disposable cartridge, however, such constructions are prohibitively expensive.

It is a further object of the present invention to provide a disposable cartridge of lightweight construction, possessing adequate inherent balance, the ability to withstand rotational forces of up to 4,000 g without distortion sufficient to slow the cartridge significantly, be economic to manufacture and for a user to purchase and be fabricated wholly, except for the bearings, from thin sheet metal components as distinct from employing cast components.

It has been found with known cartridge bases fabricated from sheet metal and having separate nozzle pieces that in addition to the disadvantages arising from turbulent oil flow they are also insufficiently rigid. This is manifested in that at high oil pressures the base tends to distort and may cause the bearing which is usually incoporated into the base to jam on the shaft about which the cartridge is rotating and stop the cartridge. When the oil pressure falls the base may again assume its previous shape and begin to rotate again. This, however, may not occur as permanent deformation can be caused and the cartridge will remain jammed on its shaft. This is quite evidently intolerable as the cartridge stopping negates the whole object of using a centrifugal separator. It has been found that the same cartridge base which promotes less turbulent oil flow also because of its configuration is sufficiently rigid to overcome the latter additional disadvantage of known cartridges described above. The effect of the distortion of known cartridges is often likened to a child's "frog-clicker" toy where a piece of curved, dished sheet metal is bent over-centre and then released to produce a clicking noise.

According to the present invention a disposable cartridge for a centrifugal separator for cleaning fuel or lubricating oil comprises a cover member, an inner flow directing and debris-retaining member, a base member, two bearings, one associated with the cover member and the other with the base member and wherein the base member is a sheet metal presssing having at least two nozzles formed integrally therein and through which oil leaves the cartridge in a direction so as to produce a reaction force to spin the cartridge, the nozzles being provided in recesses in the base member, the recesses being in the form of smoothly contoured circumferential troughs of deepening section starting with minimum depth at the beginning of the trough remote from the nozzle and finishing with maximum depth near to the plane in which the nozzle lies.

The lengths of the troughs will depend on the number of nozzles employed. For example, where two nozzles are used and disposed at 180° intervals from each other in the base member the troughs may preferably extend for approximately 180°. Similarly, for three nozzles the troughs may preferably extend for approximately 120°. Thus, preferably the minimum depth beginning of each trough lies closely adjacent the maximum depth nozzle area of an adjacent trough such that the troughs extend over approximately 360°. Each trough preferably extends over approximately 360° divided by the number of troughs, e.g., with two nozzles and two troughs, the troughs preferably each extend over approximately 180°.

Preferably the nozzles are punched in the base member by a piercing operation from the inside of the trough during a stage of the forming operation. It is important that no 'rag edges' or burrs are left on the inside of the nozzle as this may increase turbulence and thus impair the performance of the cartridge. Alternatively drilled nozzles may be employed but again these are preferably drilled from the inside so that any burrs are on the outside of the nozzle.

According to a feature of the present invention the cover member, inner flow directing and debris-retaining member and base member are all produced from thin sheet metal pressings.

In a preferred embodiment of the present invention a disposable cartridge for a centrifugal separator further comprises a tubular tension member disposed axially between the top cover and the base member. In such a preferred embodiment the bearings may be press-fitted into the tubular tension member thus conferring the advantage of holding the bearings in axial alignment within a single member and better able to resist forces tending to cause distortion.

Preferably, the nozzles are formed such that the direction of the issuing oil jet is directed at an angle downwardly away from the rotatable cartridge to prevent oil splash-back from the housing in which the cartridge rotates from reaching and thus slowing the cartridge.

In order that the invention may be more fully understood examples will now be described by way of illustration only with reference to the accompanying drawings of which:

FIGS. 1(*a*) and 1(*b*) show a plan and elevation (partly sectioned) view of a pressed sheet metal base member of a disposable cartridge according to the present invention;

FIGS. 2(*a*) to 2(*f*) are sections where indicated through the base member shown in FIG. 1(*a*);

FIGS. 3(*a*) to 3(*c*) show perspective views in elevation and plan from above and below of the base member at an intermediate stage in its formation and showing particularly the circumferential troughs;

Figure 1A:
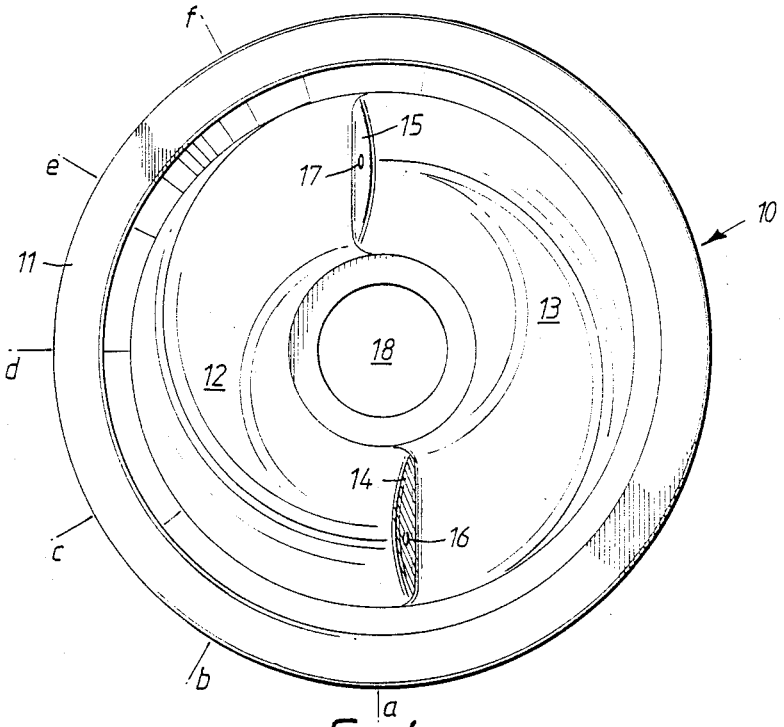
Figure 1B:
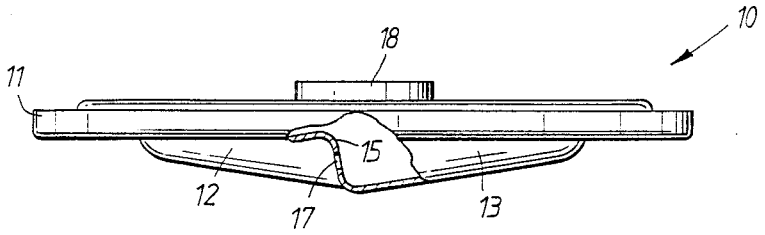
Figure 2A:
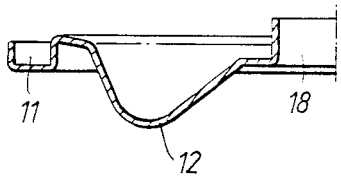
Figure 2B:
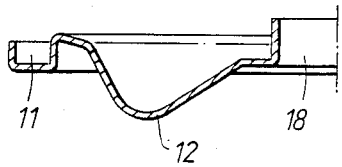
Figure 2C:
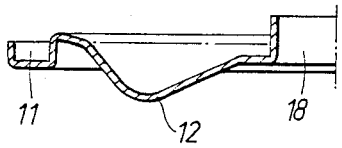
Figure 2D:
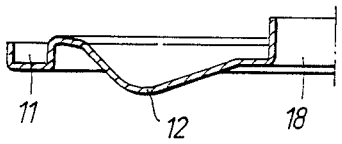
Figure 2E:
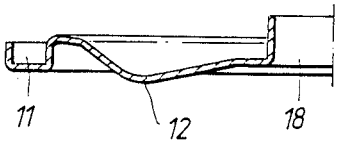
Figure 2F:
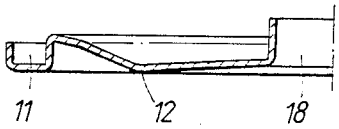

In the following descriptions similar features in the drawings are denoted by common reference numerals. Referring now to FIGS. 1(*a*) and 1(*b*), 2(*a*) to 2(*f*), 3(*a*) to 3(*c*), 4 and 5.

The base member is shown generally at 10. The base member 10 comprises a peripheral channel section 11 and two generally semi-circular trough sections 12 and 13. When viewing FIG. 1(*a*) the trough section 12 begins at its shallowest region around section 'f' see FIG. 2(*f*) in a very shallow depression and gradually increases in depth up to around section 'a' (see FIG. 2(*a*) where the trough ends at its deepest point in wall 14 which is also at a small downwardly sloping angle of approximately 10° to a plane parallel to the base axis. Trough section 13 is also similarly formed in the reverse direction terminating in wall 15. The walls 14 and 15 have nozzles 16 and 17 pierced in them from the inside respectively. The nozzles 16 and 17 are pierced normal to the plane of the walls 14 and 15 and thus are downwardly directed at an approximate angle of 10° to a plane normal to the axis of the base 10. The diameter of the nozzle may be optimised to suit the oil type, viscosity and oil temperature of the intended application but may typically be of the order of 1.5 mm. In the center of the base member 10 is a flanged hole 18 defining a location for a bearing 26 either directly or in a tubular tension member 40. The gradually deepening troughs 12 and 13 possess diametral symmetry. The base member is pressed in a series of pressing steps from a single piece of 0.91 mm thick mild steel, the nozzles 16 and 17 being pierced from the inside. The channel 11 is for joining the base member 10 to a domed cover member 20 with a rolled seam 25.

Figure 3B:
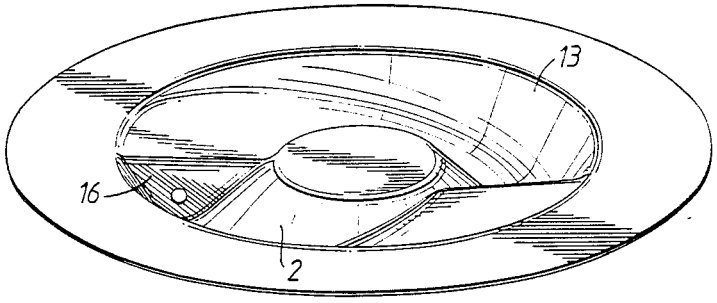
Figure 3A:
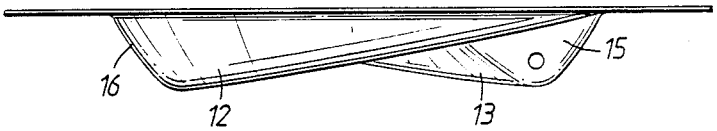
Figure 3C:
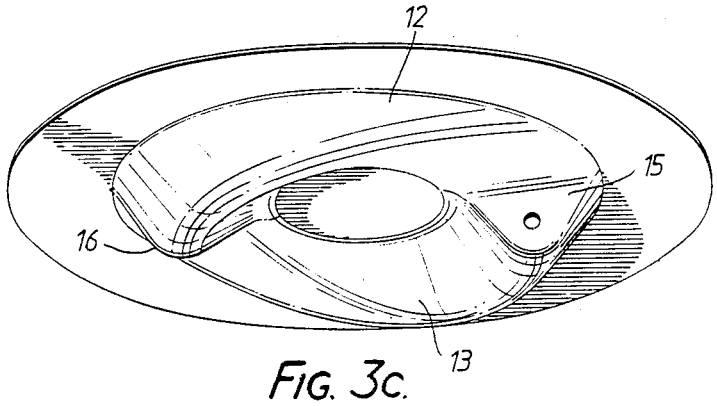

FIG. 3(*a*) shows a side elevation of the base member 10 at a stage where the troughs 12 and 13 have been pressed but the nozzles 16 and 17 the channel 11 and the central hole 18 have yet to be formed. FIG. 3(*b*) is a perspective view of the inside of the base member 10 and FIG. 3(*c*) a perspective view of the outside of the base member 10.

Figure 4:
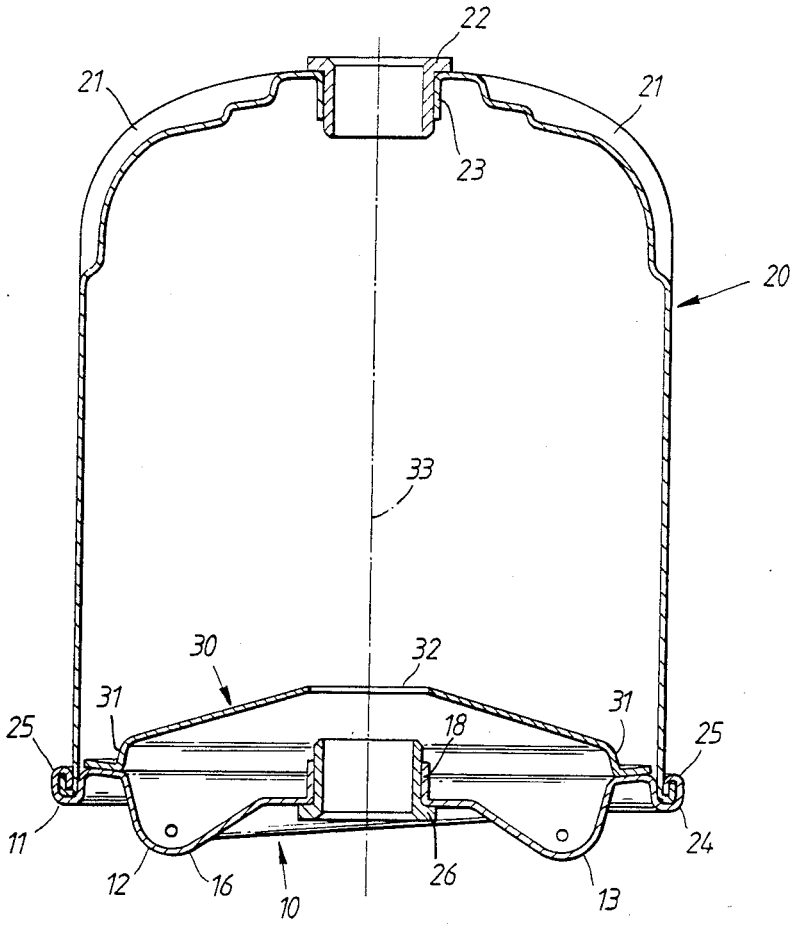
FIG. 4 shows a section in elevation through an embodiment of a disposable cartridge according to the present invention.

A complete cartridge is shown in FIG. 4 where the disposable cartridge comprises a domed top cover 20 having at its upper end pressed-in reinforcing depressions 21 disposed radially, and a flanged blaring 22 press-fitted into a flanged hole 23. The lower periphery 24 of the domed cover 20 rests in the channel 11 of the base member 10 and a rolled seam 25 is formed to produce a substantially leak-free joint between the cover 20 and the base 10. In the base member 10 is a flanged bearing 26 press-fitted into the flanged hole 18. Within the cartridge is a dished flow directing and debris-retaining member 30 having an annular peripheral flanged portion 31 spot welded to the base member 10. In the center of the member 30 is a hole 32 being symmetrical about the cartridge axis 33.

Figure 5:
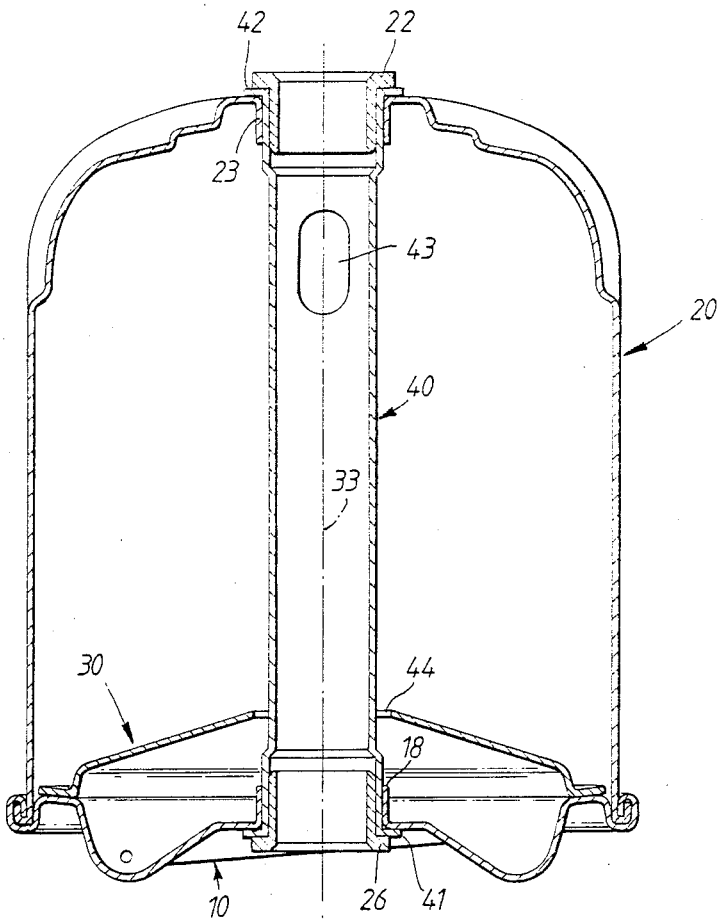
FIG. 5 shows a section in elevation through a first alternative embodiment of a disposable cartridge according to the present invention.

In the alternative embodiment shown in FIG. 5 a tubular tension member 40 is disposed between the top cover 20 and the base member 10. The tubular member 40 has an outwardly turned flange 41 at its lower end such that the flange 41 is outside and supportive of the base member 10 and a second outwardly turned flange 42 at its upper end again outside and supportive of the top cover 20. The tubular tension member 40 is a press-fit in the two flanged holes 23 and 18 in the top cover 20 and base member 10 respectively. In the upper portion of the member 40 are oil entry holes 43. The bearings 22 and 26 are press-fitted directly into the tubular member 40 which is coaxial with the cartridge axis 33. An annular opening 44 is defined by the member 30 and the tension member 40. The tubular member 40 serves to resist tensile stresses resulting from high oil pressures which tends to expand the cartridge both radially and axially. Furthermore the tubular member also provides a repeatable datum in which to insert the bearings 22 and 26 and to maintain axial alignment even at high oil pressures.

Figure 6:
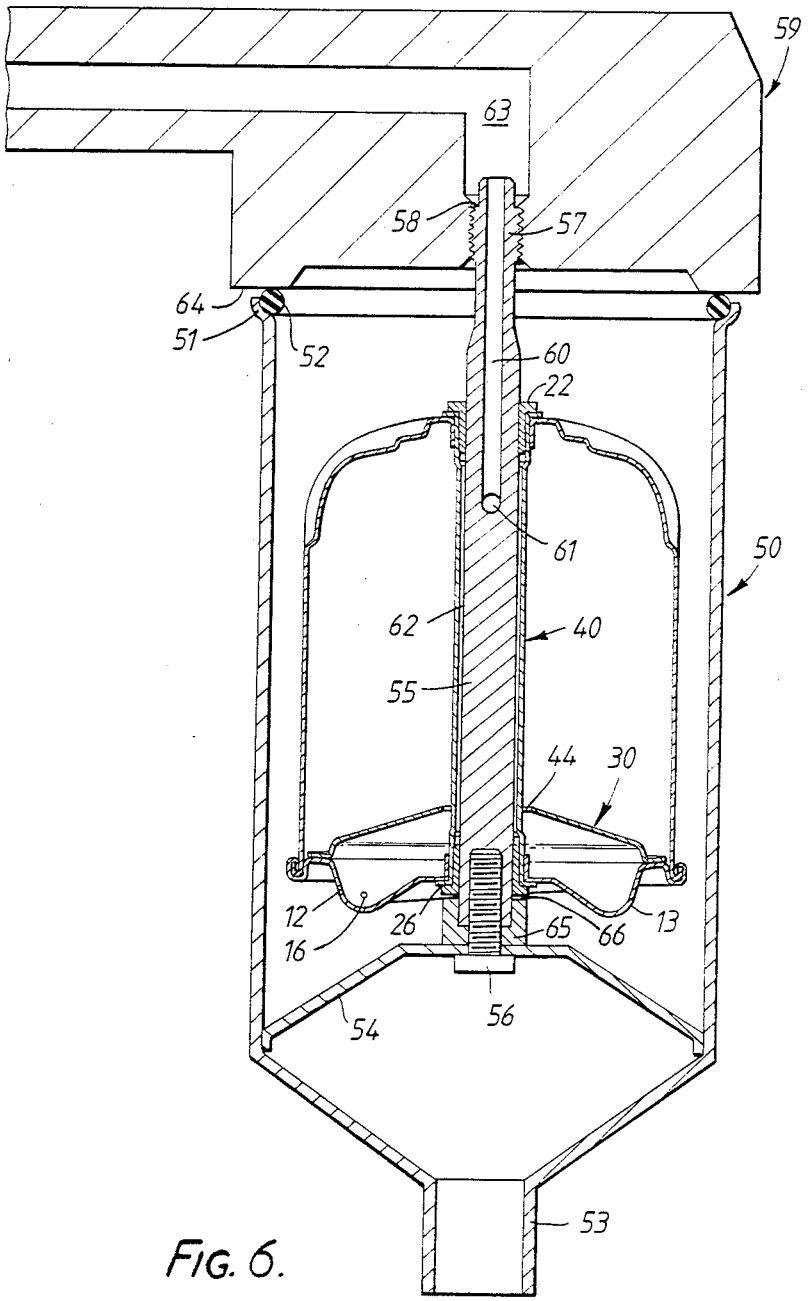
FIG. 6 shows the disposable cartridge of FIG. 5 installed in a centrifugal separator housing.

FIG. 6 shows the cartridge of FIG. 5 in a centrifugal separator housing. The housing comprises a body member 50. At the body 50 upper end there is a rebated lip 51 to receive and locate a rubber sealing ring 52. At the body 50 lower end there is a tapered portion 53. Within the body 50 a cruciform sheet metal structure 54 is spot-welded to the body 50 and supports a vertical shaft 55 by a bolt 56. Located between shaft 55 and bolt 56 is a bush 65, the upper face 66 of which provides a thrust surface. The shaft 55 has at its upper end a male threaded portion 57 which co-operates with a female threaded portion 58 in, for example, a support housing 59 on an engine cylinder block (not shown). Part of the upper end of the shaft 55 is drilled axially with a conduit 60 which also comprises a cross drilling 61 opening out into the tubular member 40 of the cartridge. The shaft 55 and tubular member 40 define a cylindrical annulus 62. Oil is supplied to the conduit 60 via a passage 63 formed in the housing 59. The body 50 and cartridge are secured to the housing 59 by screwing the complete body 50 on to the housing 59 by the co-operating threads 57 and 58 the sealing ring 52 being compressed into the rebated lip 51 and sealing against the face 64 of the housing 59.

In steady state operation oil under a pressure of about 5 bar flows through the passage 63, into the conduit 60 and out of the cross drilling 61. The annulus 62 fills with oil and then flows through the oil entry holes 43 into the chamber of the cartridge formed between the base 10, the top cover 20 and the tubular member 40. When the chamber so defined is full oil is ejected under pressure from the nozzles 15 and 16 thus causing the cartridge to rotate by a reaction force, the cartridge being supported on the shaft 55 by the bearings 22 and 26. The top face of the bush 65 provides a thrust face for the bearing 26. The ejected oil flows down the inner walls of the body 50 through the restriction 53 where it drains away to an oil sump or tank (not shown).

The direction of rotation of the cartridge is preferably such that the oil drag produced on the body 50 tends to tighten the body on the co-operating screw threads 57 and 58. Thus in FIG. 6 where threads 57 and 58 are right-hand threads the direction of rotation of the cartridge will be clockwise when viewed from below.

Because of the gradually deepening troughs 12 and 13 and the burr-free nozzles oil flow up to and through the nozzles 15 and 16 is less turbulent than heretofore.

The table below shows the results obtained of tests to measure cartridge rotational velocity and oil flow rates at various oil pressures. The cartridges were constructed to known principles and according to the principles of the present invention. Three types of cartridge were produced:

Cartridge A having a known base with separate brazed-in nozzle pieces and no tubular tension member;

Cartridge B having the same base as Cartridge A but including a tubular tension member; and Cartridge C having a tubular tension member and a base member according to the present invention.

TABLE

| Engine Oil | Oil Flow Rate (l/min) | | | Rotational Speed of Cartridge (rev/min) | | | | | |
|---|---|---|---|---|---|---|---|---|---|
| Pressure (Bar) | A | B | C | A | B | % inc. over A | C | % inc. over A | % inc. over B |
| 2 | 4.5 | 4.7 | 4.5 | 3250 | 3650 | 12.3 | 3800 | 16.9 | 4.1 |
| 3 | 5.55 | 5.75 | 5.5 | 4200 | 4700 | 11.9 | 5200 | 23.8 | 10.6 |
| 4 | 6.6 | 6.8 | 6.4 | 5050 | 5700 | 12.9 | 6400 | 26.7 | 12.3 |
| 5 | 7.5 | 7.9 | 7.45 | 5900 | 6700 | 13.5 | 7600 | 28.8 | 13.4 |
| 6 | 8.4 | 8.9 | 8.4 | 6700 | 7650 | 14.2 | 8750 | 30.6 | 14.4 |
| 7 | 9.1 | 9.7 | 9.25 | 7300 | 8350 | 14.4 | 9800 | 34.2 | 17.4 |

It may be seen from Table 1 by comparing the improvement of rotational speed of Cartridge B over Cartridge A that the tubular tension member gives a substantially constant improvement of about 12 to 14% over the whole range of oil pressures tested. Comparing now the improvement in rotational speed of Cartridge C over Cartridge B where the constructional difference is in the base and nozzles it may be seen that the improvement in rotational speed increases with increasing oil pressure. If one now observes the oil flow-rate through the nozzles of the cartridges at the various oil pressures it will be readily apparent that there is in fact little difference. The greatly improved performance of Cartridge C over both Cartridges A and B is, therefore, attributable to the reduction in turbulence of the issuing oil jets and possibly partly to the improved stiffness of the new base.

The higher rotational speeds of cartridges according to the present invention provide more effective contaminant removal from engine and transmission oil systems thus providing extended lives.

Cartridges according to the invention may be made having up to four nozzles disposed at 90° intervals about the base member and still giving oil flow having reduced turbulence. However, the overall oil flow rate through the cartridge at a given oil pressure needs to be maintained substantially constant and, therefore, the nozzle size requires to be reduced. It has been found that optimum performance allied to economy and ease of production may be achieved with two nozzles.

I claim:

1. A disposable cartridge for a centrifugal separator for cleaning fuel or lubricating oil; said cartridge comprising a cover member, an inner flow directing and debris-retaining member, a base member, two bearings, one each associated with said cover member and said base member and wherein said base member is a sheet metal pressing having at least two nozzles therein and through which oil leaves said cartridge in a direction so as to produce a reaction force to spin said cartridge, said nozzles being provided in recesses in said base member, said recesses being in the form of smoothly-contoured circumferentially extending troughs of gradually deepening section starting with minimum depth at the beginning of the trough remote from said nozzle and finishing with maximum depth near to the plane in which said nozzle lies, and the minimum depth beginning of each trough lying closely adjacent the maximum depth nozzle area of an adjacent trough such that the troughs extend over approximately 360°.

2. A disposable cartridge according to claim 1 and wherein said nozzles are formed integrally with said troughs.

3. A disposable cartridge according to claim 2 and wherein said nozzles are pierced from the inside of said troughs.

4. A disposable cartridge according to claim 2 and wherein said nozzles are formed by drilling from the inside.

5. A disposable cartridge according to claim 1 and wherein there are two nozzles and said troughs each extend over approximately 180°.

6. A disposable cartridge according to claim 1 and wherein there are three nozzles and said troughs each extend over approximately 120°.

7. A disposable cartridge according to claim 1 and wherein there are four nozzles and said troughs each extend over approximately 90°.

8. A disposable cartridge according to claim 1 and wherein there is further provided a reinforcing tension member of tubular form disposed between the top of said cover member and said base member.

9. A disposable cartridge according to claim 8 and wherein said tubular reinforcing tension member also receives said bearings and maintains said bearings in alignment.

10. A disposable cartridge according to claim 1 wherein a space defined vertically by said base member and said flow-directing and debris-retaining member and lying laterally outwardly of said base member bearing is open and free of obstructions so as to minimize turbulence in liquid flowing into said troughs and thence said nozzles.

11. A base member for combining with a cover member to form a cartridge for a centrifugal separator, said base member comprising a sheet metal pressing having nozzles in recesses located and oriented such that pressurized fluid passing from the recessees through the nozzles will produce a reaction force to spin said base member about its central axis, each recess being in the form of a smoothly-contoured circumferential trough of gradually deepening section starting with minimum depth at the beginning of the trough remote from said nozzle and finishing with maximum depth near to the plane in which said nozzle lies, and the minimum depth beginning of each trough lying closely adjacent the maximum depth nozzle area of an adjacent trough such that the troughs extend over approximately 360°.

12. A base member according to claim 11 wherein each trough extends over approximately 360° divided by the number of troughs.

13. A disposable cartridge for a centrifugal separator for cleaning fuel or lubricating oil; said cartridge comprising a cover member, an inner flow directing and debris-retaining member, a base member, two bearings, one each associated with said cover member and said base member and wherein said base member is a sheet metal pressing having at least two nozzles therein and through which oil leaves said cartridge in a direction so as to produce a reaction force to spin said cartridge, said nozzles being provided in recesses in said base member, said recesses being in the form of smoothly-contoured circumferentially extending troughs of gradually depening section starting with minimum depth at the beginning of the trough remote from said nozzle and finishing with maximum depth near to the plane in which said nozzle lies, and each trough extending over approximately 360° divided by the number of troughs.

* * * * *